US010477300B2

(12) United States Patent
Hong et al.

(10) Patent No.: US 10,477,300 B2
(45) **Date of Patent: *Nov. 12, 2019**

(54) AIR PULSE GENERATING ELEMENT AND SOUND PRODUCING DEVICE

(71) Applicant: xMEMS Labs, Inc., Los Altos, CA (US)

(72) Inventors: David Hong, Los Altos, CA (US); Chiung C. Lo, San Jose, CA (US); Jemm Yue Liang, Sunnyvale, CA (US)

(73) Assignee: xMEMS Labs, Inc., Los Altos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/379,746

(22) Filed: Apr. 9, 2019

(65) Prior Publication Data

US 2019/0238974 A1 Aug. 1, 2019

Related U.S. Application Data

(63) Continuation-in-part of application No. 16/172,876, filed on Oct. 29, 2018, now Pat. No. 10,327,060.

(60) Provisional application No. 62/581,741, filed on Nov. 5, 2017, provisional application No. 62/719,694, filed on Aug. 19, 2018.

(51) Int. Cl.
*H04R 1/28* (2006.01)
*H04R 3/04* (2006.01)

(52) U.S. Cl.
CPC ..... *H04R 1/2811* (2013.01); *H04R 3/04* (2013.01)

(58) Field of Classification Search
CPC ..... H04R 1/2811; H04R 3/04; H04R 1/28; H04R 5/02; H04R 1/02
USPC ..... 381/174, 175, 150, 151
See application file for complete search history.

(56) References Cited

U.S. PATENT DOCUMENTS

| | | | | |
|---|---|---|---|---|
| 10,327,060 | B2 * | 6/2019 | Lo | H04R 1/02 |
| 2013/0223023 | A1 | 8/2013 | Dehe | |
| 2016/0381464 | A1 * | 12/2016 | Elyada | H04R 19/02 381/97 |
| 2017/0201192 | A1 | 7/2017 | Tumpold | |

FOREIGN PATENT DOCUMENTS

WO 2016/202790 A2 12/2016

OTHER PUBLICATIONS

Lo, Title of Invention: Air Pulse Generating Element and Sound Producing Device, U.S. Appl. No. 16/172,876, filed Oct. 29, 2018.
David Hong et al., Title: Method for Manufacturing Air Pulse Generating Element, pending U.S. Appl. No. 16/380,988, filed Apr. 10, 2019.

* cited by examiner

*Primary Examiner* — Curtis A Kuntz
*Assistant Examiner* — Julie X Dang
(74) *Attorney, Agent, or Firm* — Winston Hsu

(57) ABSTRACT

An air pulse generating element, disposed in a sound producing device, includes a membrane, disposed within a chamber; and a plurality of valves, disposed by the membrane within the chamber, configured to seal a plurality of openings of the chamber in response to a plurality of valve control signals; wherein the membrane and the plurality of valves are all fabricated at a first layer.

18 Claims, 11 Drawing Sheets

(8a)

(8b)

(8b)

(8a)

AIR PULSE GENERATING ELEMENT AND SOUND PRODUCING DEVICE

CROSS REFERENCE TO RELATED APPLICATIONS

This application is a continuation-in-part application of Ser. No. 16/172,876, filed on Oct. 29, 2018, which further claims the benefit of U.S. provisional application No. 62/581,741, filed on Nov. 5, 2017, and U.S. provisional application No. 62/719,694, filed on Aug. 19, 2018.

BACKGROUND OF THE INVENTION

1. Field of the Invention

The present application relates to an air pulse generating element and a sound producing device, and more particularly, to an air pulse generating element and a sound producing device with low manufacturing complexity and low yield loss rate.

2. Description of the Prior Art

Speaker driver and back enclosure are two major design challenges in the speaker industry. It is difficult for a conventional speaker driver to cover an entire audio frequency band, e.g., from 20 Hz to 20 KHz, due to a membrane displacement D is proportional to $1/f^2$, i.e., $D \propto 1/f^2$. On the other hand, to produce sound with high fidelity, a volume/size of back enclosure for the conventional speaker is required to be sufficiently large.

To combat against the design challenges in the above, applicant has proposed an air pulse generating element and a sound producing device in U.S. application Ser. No. 16/125,761, which produce sound using a plurality of pulses at a pulse rate, where the pulse rate is higher than a maximum audible frequency and the plurality of pulses is regarded as being amplitude modulated according to an input audio signal. By exploiting a low pass effect caused by ambient environment and human ear structure, a sound corresponding to the input audio signal is perceived. The sound producing device in U.S. application Ser. No. 16/125,761 is able to cover the entire audio frequency band, and an enclosure volume/size of which is significantly reduced.

However, the air pulse generating element in U.S. application Ser. No. 16/125,761 is complicated to be manufactured, because it requires 3 different layers to manufacture the valves and the membrane thereof, suffering from high yield loss rate. Specifically, FIG. 1 is a sectional view of an air pulse generating element 10 in U.S. application Ser. No. 16/125,761. The air pulse generating element 10 comprises valves 101-104, a membrane 105, a front faceplate 106 and a back faceplate 107. The membrane 105 partitions a chamber 108 into a front sub-chamber 108_*f* and a back sub-chamber 108_*b*. The air pulse generating element 10 is a MEMS (micro electrical mechanical system) device. The valves 101 and 103 are fabricated at a layer 1, the membrane 105 is fabricated at a layer 3, and the valves 102 and 104 are fabricated at a layer 5. Manufacturing the valves 101-104 and the membrane 105 at the layers 1, 3, 5 require high wafer cost. In addition, one yield loss of one single layer among the layers 1, 3, 5 would lead to a failure of the entire air pulse generating element 10. Thus, the yield loss rate of the 3-layered air pulse generating element 10 is high.

Therefore, it is necessary to lower the manufacturing complexity of the air pulse generating element.

SUMMARY OF THE INVENTION

It is therefore a primary objective of the present application to provide an air pulse generating element and a sound producing device with low manufacturing complexity and low yield loss rate.

An embodiment of the present invention discloses an air pulse generating element disposed in a sound producing device. The air pulse generating element comprises a membrane, disposed within a chamber; and a plurality of valves, disposed by the membrane within the chamber, configured to seal a plurality of openings of the chamber in response to a plurality of valve control signals; wherein the membrane and the plurality of valves are all fabricated at a first layer.

An embodiment of the present invention discloses a sound producing device. The sound producing device comprises a plurality of air pulse generating elements, wherein an air pulse generating element comprises a membrane, disposed within a chamber; and a plurality of valves, disposed by the membrane within the chamber, configured to seal a plurality of openings of the chamber in response to a plurality of valve control signals; wherein the membrane and the plurality of valves are all fabricated at a first layer; and a control unit, configured to generate the plurality of valve control signals.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
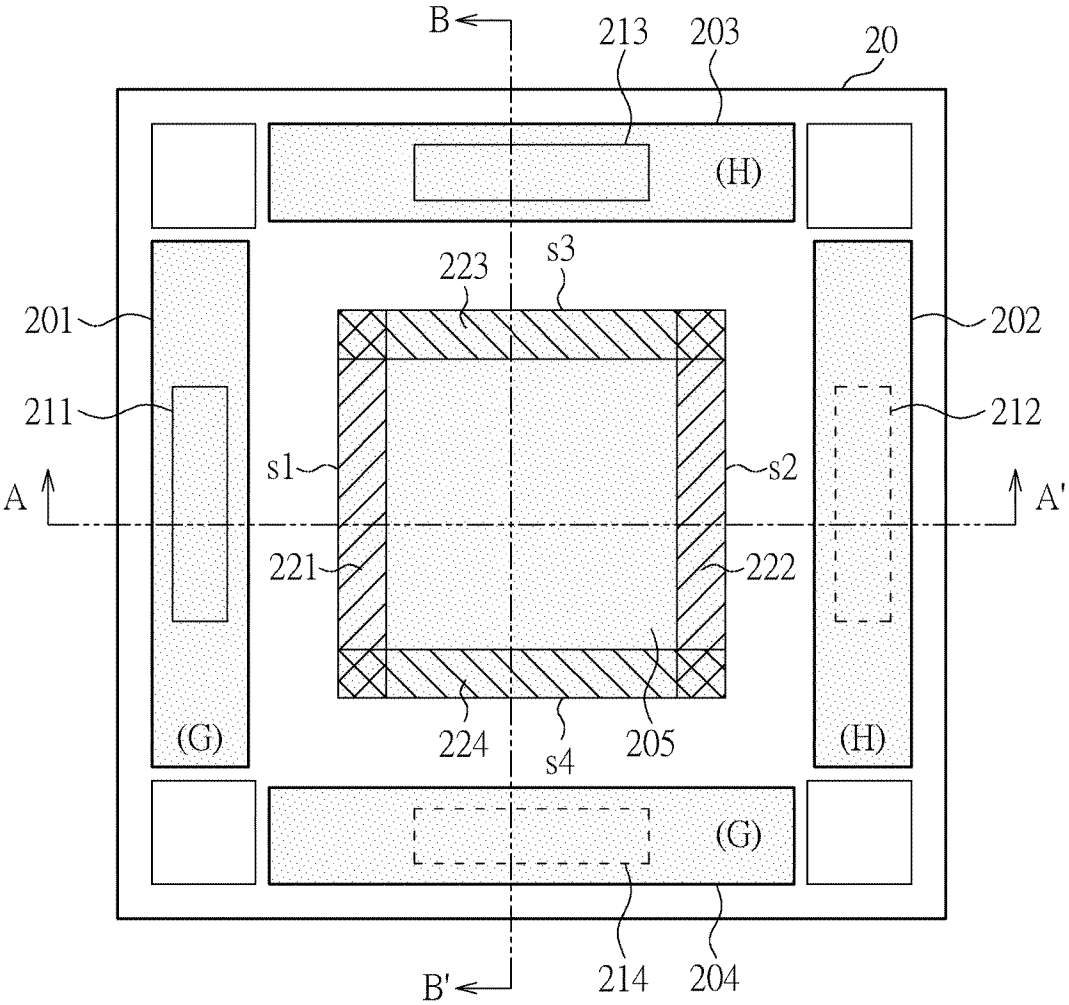
FIG. 2 is a top view of an air pulse generating element according to an embodiment of the present invention.
Figure 3:
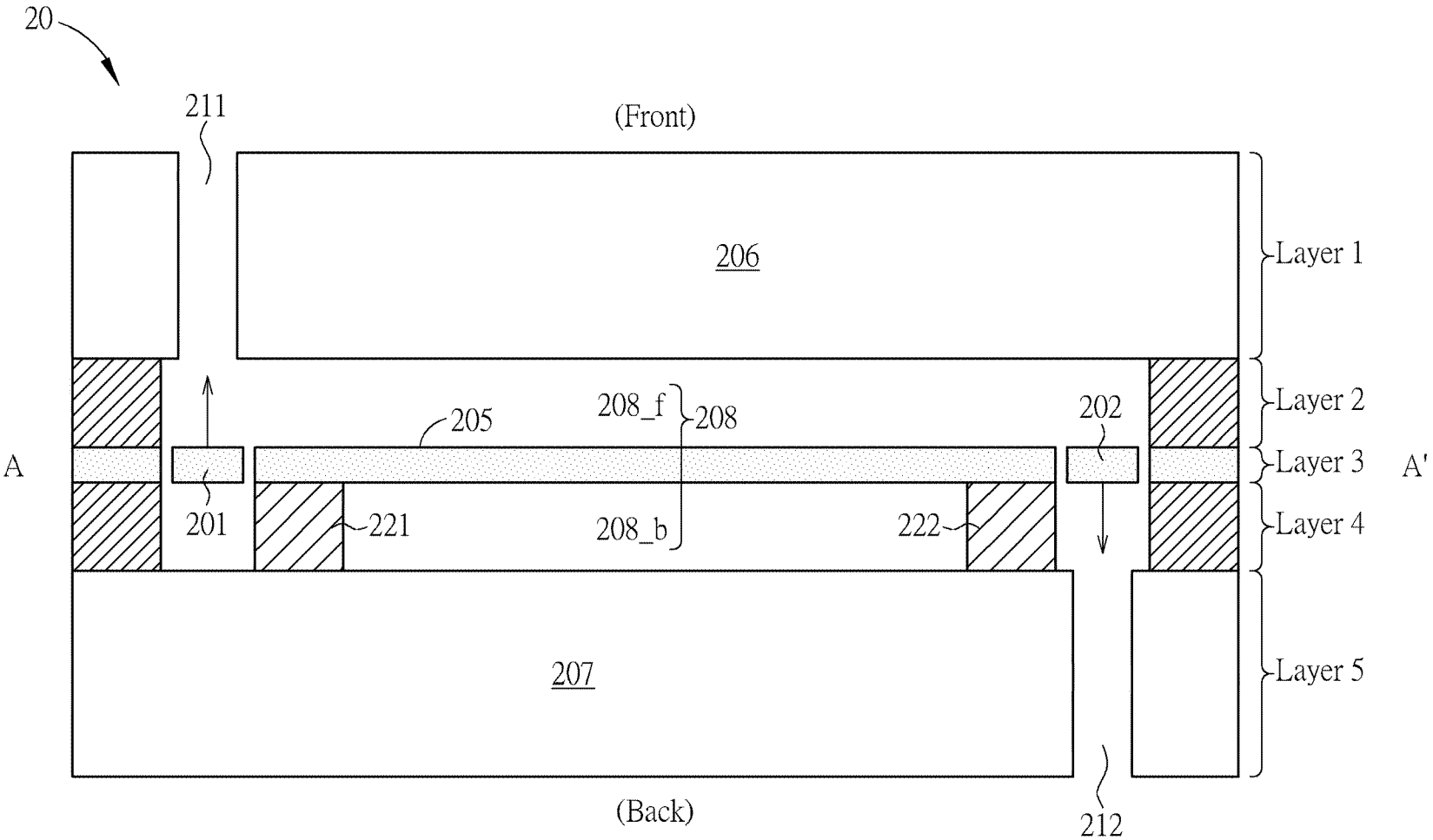
FIG. 3 is a first sectional view of the air pulse generating element of FIG. 2.
Figure 4:
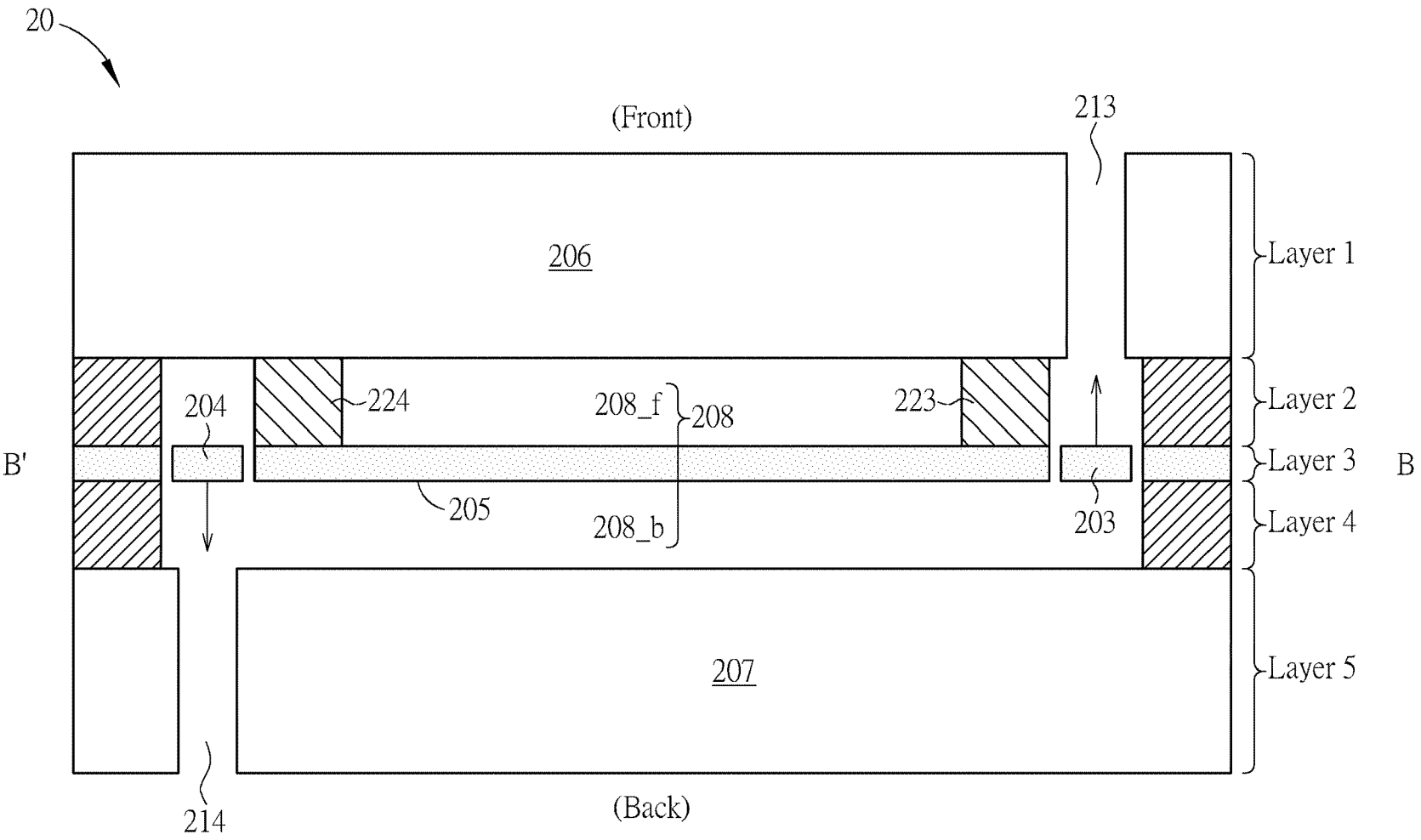
FIG. 4 is a second sectional view of the air pulse generating element of FIG. 2.

FIG. 2 is a top view of an air pulse generating element 20 according to an embodiment of the present invention. FIG. 3 is a sectional view of the air pulse generating element 20 through an A-A' line shown in FIG. 2. FIG. 4 is a sectional view of the air pulse generating element 20 through a B-B' line shown in FIG. 2. The air pulse generating element 20 comprises valves 201-204, a membrane 205, a front faceplate 206 and a back faceplate 207. The valves 201-204 are disposed by four sides s1-s4 of the membrane 205, respectively, within a chamber 208. The membrane 205 partitions the chamber 208 into a front sub-chamber 208_*f* and a back sub-chamber 208_*b*. The valves 201-204 may be controlled by a plurality of valve control signals, respectively. The air pulse generating element 20 is a MEMS (micro electrical mechanical system) device. In an embodiment shown in FIGS. 2-4, the front faceplate 206 is disposed at a layer 1, the valves 201-204 and the membrane 205 are all fabricated at a layer 3, and the back faceplate 207 is disposed at a layer 5. Supporting elements 223, 224 are fabricated at a layer 2, and supporting elements 221, 222 are fabricated at a layer 4.

Openings 211 and 213 are formed within the front faceplate 206, and openings 212 and 214 are formed within the back faceplate 207. In an embodiment, the valve 201 is controlled in response to a valve control signal G to move upward to seal the openings 211, the valve 202 is controlled in response to a valve control signal H to move downward to seal the openings 212, the valve 203 is controlled in response to the valve control signal H to move upward to seal the openings 211, and the valve 204 is controlled in response to the valve control signal G to move downward to seal the openings 214.

In the embodiment stated in the above, the valve control signals G and H are configured to control the valves 201-204 to perform an open-and-close movement. When the valve control signal G controls the valves 201, 204 to be opened, denoted as "G=1", the opening 211, 214 are not sealed and air flows through the opening 211, 214. When the valve control signal G controls the valves 201, 204 to be closed, denoted as "G=0", the opening 211, 214 are sealed and air is not able to flow through the opening 211, 214. When the valve control signal H controls the valves 202, 203 to be opened, denoted as "H=1", the opening 212, 213 are not sealed and air flows through the opening 212, 213. When the valve control signal H controls the valves 202, 203 to be closed, denoted as "H=0", the opening 212, 213 are sealed and air is not able to flow through the opening 212, 213.

In addition, the membrane 205 is controlled in response to a membrane driving voltage $V_{MBN}$ to either move upward (i.e., from back to front) or move downward (i.e., from front to back). In other words, the valve control signals G and H are configured to control the valves 201-204 to perform an open-and-close movement, and the membrane driving voltage $V_{MBN}$ is configured to drive the membrane to perform an up-and-down movement. When the membrane 205 moves upward, an instantaneous front air pressure of the front sub-chamber 208_*f* is increased and an instantaneous back air pressure of back sub-chamber 208_*b* is decreased. When the membrane 205 moves downward, the instantaneous front air pressure of the front sub-chamber 208_*f* is decreased and the instantaneous back air pressure of the back sub-chamber 208_*b* is increased.

Figure 5:
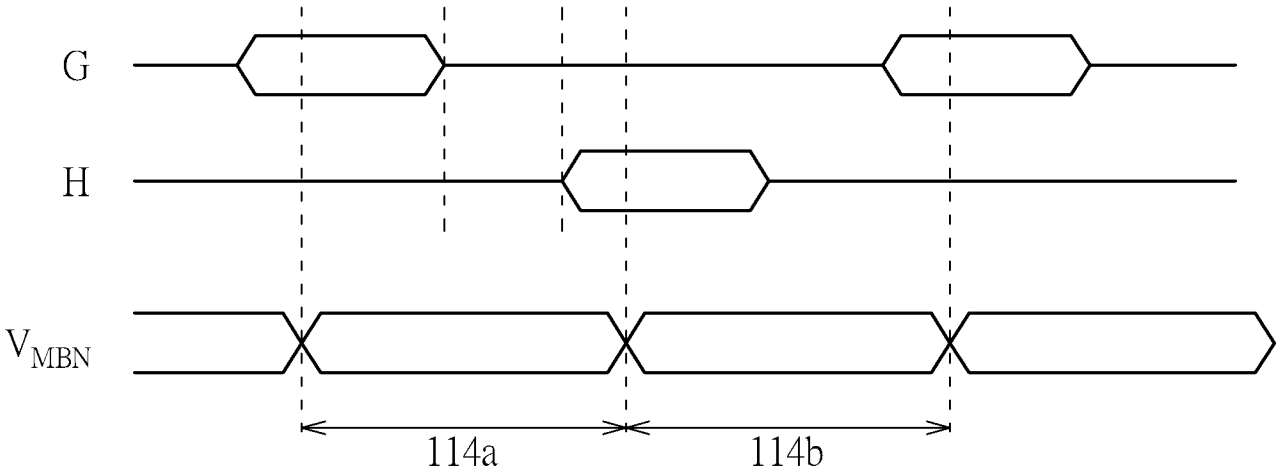
FIG. 5 is a timing diagram of valve control signals and a membrane driving voltage according to an embodiment of the present invention.

FIG. 5 is a timing diagram of the valve control signals G, H and the membrane driving voltage $V_{MBN}$ according to an embodiment of the present invention. In FIG. 5, hexagons within the timing diagram of the valve control signals G, H represents that the corresponding valve(s) is opened, i.e., G=1 or H=1, and straight lines within the timing diagram of the valve control signals G, H represents that the corresponding valve (s) is closed, i.e., G=0 or H=0. The valve control signals G, H and the membrane driving voltage $V_{MBN}$ are mutually synchronized.

A pulse cycle 114*a* begins at a status of G=1 and H=0. If the membrane driving voltage $V_{MBN}$ drives the membrane 205 to move upward (i.e., from back to front) during the pulse cycle 114*a*, the air is pushed from the front sub-chamber 208_*f* to a front environment through the opening 211 and pulled from a back environment to the back sub-chamber 208_*b* through the opening 214, and therefore a positive air pulse (in a back-to-front direction) is generated. If the membrane driving voltage $V_{MBN}$ drives the membrane 205 to move downward (i.e., from front to back) during the pulse cycle 114*a*, the air is pulled from the front environment to the front sub-chamber 208_*f* through the opening 211 and pushed from the back sub-chamber 208_*b* to the back environment through the opening 214, and therefore a negative air pulse (in a front-to-back direction) is generated.

In other words, during the pulse cycle 114*a* beginning at the status of G=1 and H=0, i.e., the valves 201, 204 being opened and the 202, 203 being closed, the membrane movement direction corresponding of the membrane 205 would be substantially the same as the air pulse direction.

A pulse cycle 114*b* begins at a status of G=0 and H=1. If the membrane driving voltage $V_{MBN}$ drives the membrane 205 to move upward during the pulse cycle 114*b*, the air is pushed from the front sub-chamber 208_*f* to the back environment through the opening 212 and pulled from the front environment to the back sub-chamber 208_*b* through the opening 213, and therefore a negative air pulse is generated. If the membrane driving voltage $V_{MBN}$ drives the membrane 205 to move downward during the pulse cycle 114*b*, the air is pulled from the back environment to the front sub-chamber 208_*f* through the opening 212 and pushed from the back sub-chamber 208_*b* to the front environment through the opening 213, and therefore a positive air pulse is generated.

In other words, during the pulse cycle 114*b* beginning at the status of G=0 and H=1, i.e., the valves 201, 204 being closed and the 202, 203 being opened, the membrane movement direction corresponding of the membrane 205 would be substantially opposite to the air pulse direction.

Operations of the air pulse generating element 20 are tabulated in Table I.

TABLE I

| Up-and-Down Movement of Membrane | Status of Valves at Beginning of Pulse Cycle | |
|---|---|---|
| | G = 1, H = 0 | G = 0, H = 1 |
| Downward | Front-to-Back | Back-to-Front |
| Upward | Back-to-Front | Front-to-Back |

In addition, during the pulse cycle 114*a* or 114*b*, if the membrane driving voltage $V_{MBN}$ is constant and the membrane 205 remains static, moving neither upward nor downward, a null pulse is generated.

Note that, an air flow direction within the front sub-chamber 208_*f* is along the A-A' direction between the valve 201 and the valve 202, and an air flow direction within the back sub-chamber 208_*b* is along the B-B' direction between the valve 203 and the valve 204.

Therefore, the air pulse generating element 20 is able to perform the same function of the air pulse generating element 10 disclosed in U.S. application Ser. No. 16/125,761. Similar to the air pulse generating element 10, the air pulse generating element 20 is able to generate a plurality of air pulses in response to the valve control signals G, H and the membrane driving voltage $V_{MBN}$ at a pulse rate, where the pulse rate of the plurality of air pulses is higher than a maximum audible frequency. Different from the air pulse generating element 10, the valves 201-204 and the membrane 205 are coplanar, which means that the valves 201-204 and the membrane 205 are fabricated at the same layer. Thereby, a manufacturing cost is reduced and a yield rate is improved.

Note that, the air pulse generating element 20 has four valves disposed by four sides of the membrane, which is not limited thereto. The air pulse generating element of the present invention may comprise two valves disposed by two sides of the membrane.

Figure 6:
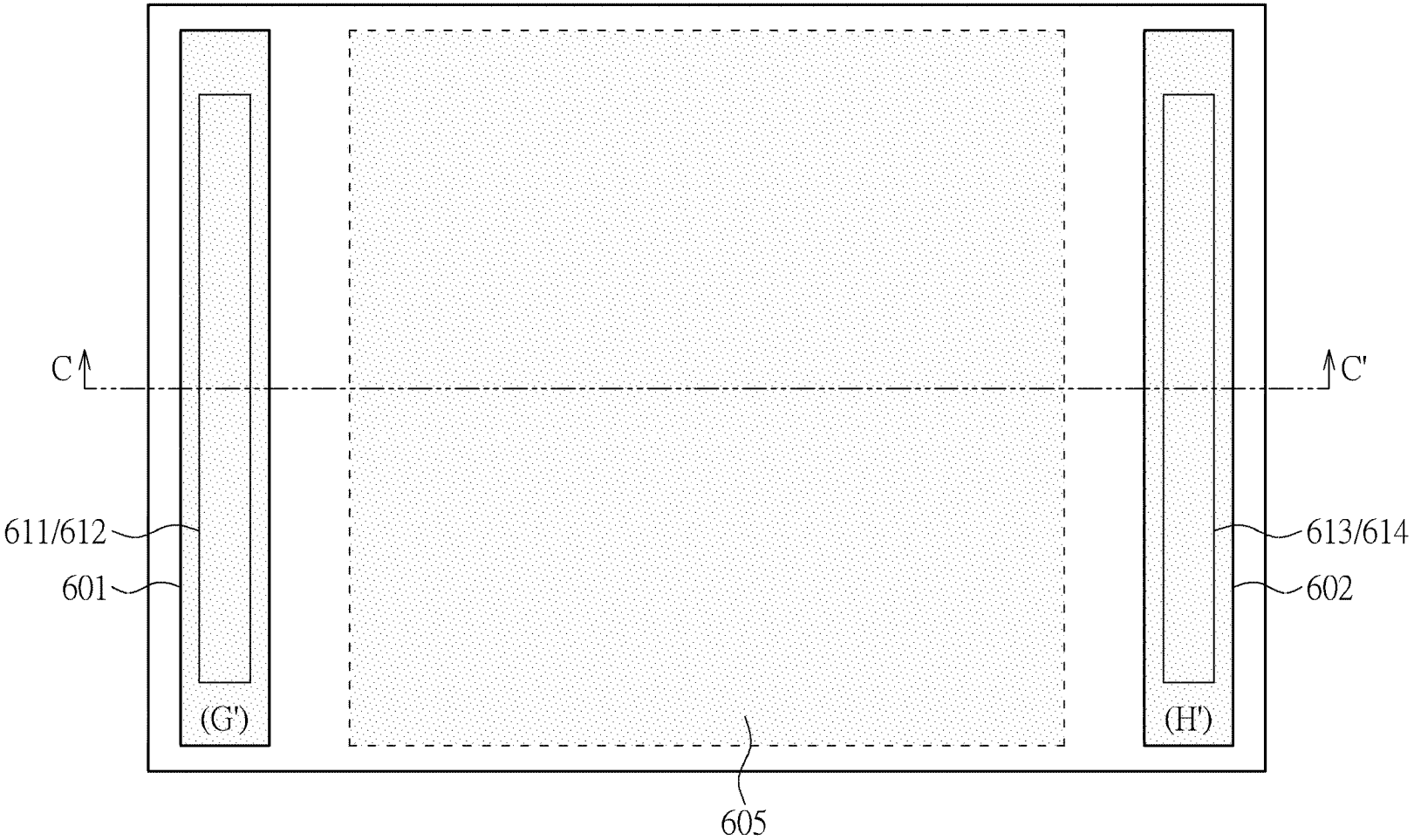
FIG. 6 is a top view of an air pulse generating element according to an embodiment of the present invention.
Figure 7:
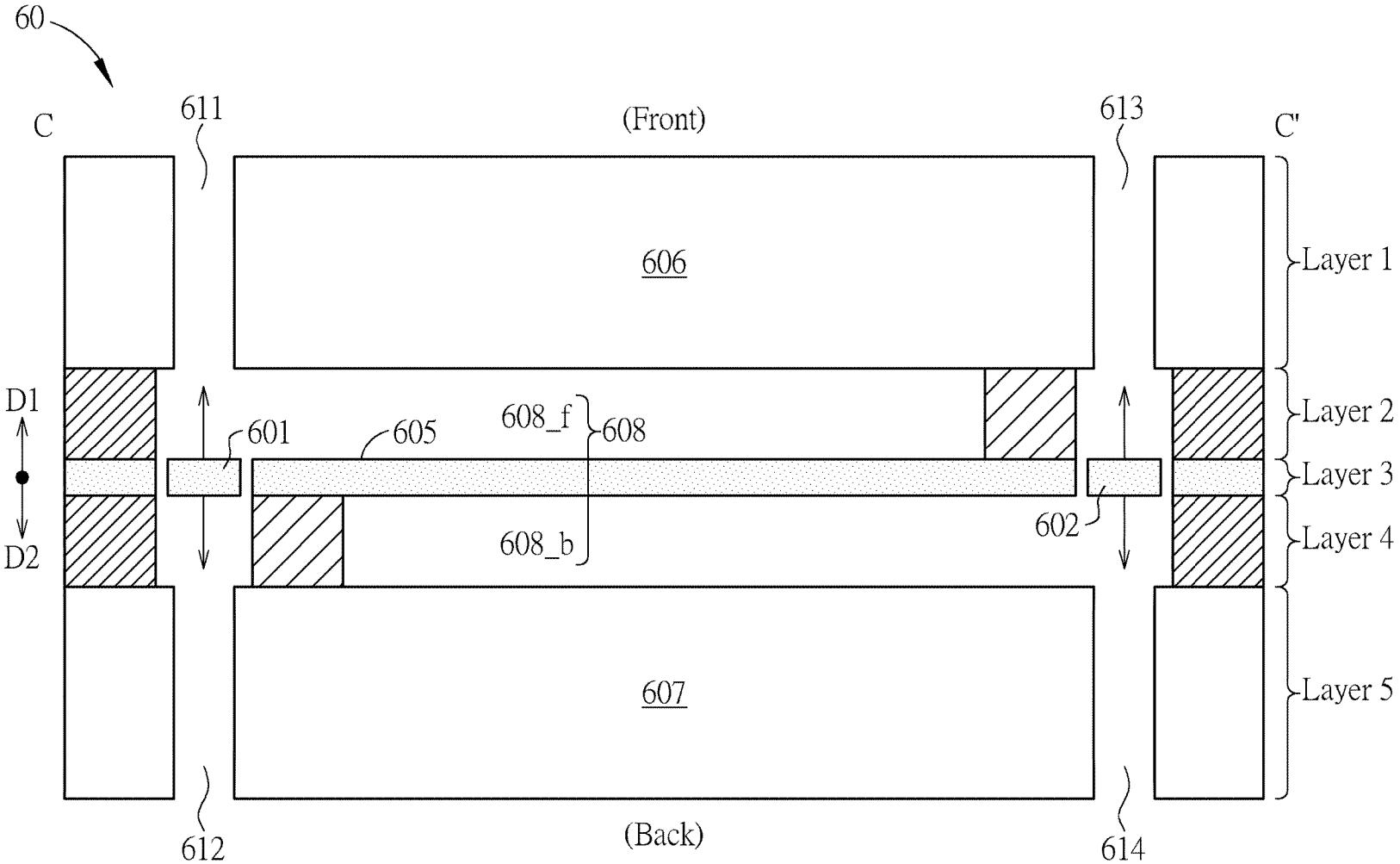
FIG. 7 is a first sectional view diagram of the air pulse generating element of FIG. 6.

FIG. 6 is a top view of an air pulse generating element 60 according to an embodiment of the present invention. FIG. 7 is a sectional view diagram of the air pulse generating element 60 through a C-C' line shown in FIG. 6. The air pulse generating element 60 is also a MEMS device.

Figure 1:
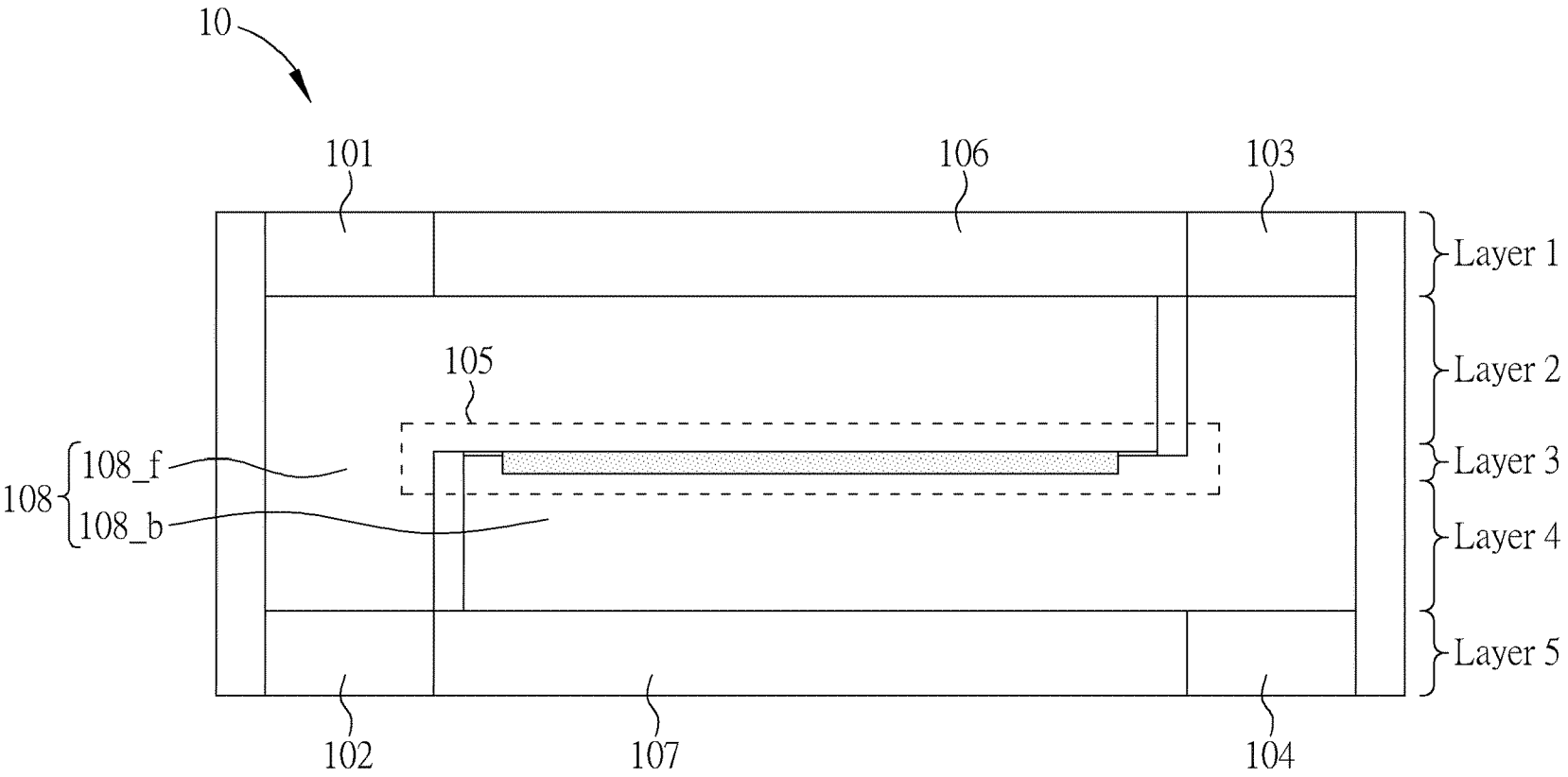
FIG. 1 PRIOR ART
FIG. 1 is a schematic diagram of an air pulse generating element in the art.

Similar to the air pulse generating element 20, the air pulse generating element 60 comprises valves 601, 602, a membrane 605, a front faceplate 606 and a back faceplate 607. The valves 601, 602 are fabricated at the same layer (e.g., Layer 3) as the membrane 605. The membrane 605 partitions the chamber 608 into a front sub-chamber 608_*f* and a back sub-chamber 608_*b*. In an embodiment shown in FIGS. 6-1, the front faceplate 606 is disposed at the layer 1, the valves 601-604 and the membrane 605 are all fabricated at the layer 3, and the back faceplate 607 is disposed at the layer 5. Openings 611 and 613 are formed within the front faceplate 606, and openings 612 and 614 are formed within the back faceplate 607. The valve 601 is controlled by a valve control signal G' to alternatively seal the openings 611 and 612, which means that the valve 601 may be controlled by the signal G' to seal the opening 611 at a first time and to seal the opening 612 at a second time. Similarly, the valve 602 is controlled by the valve control signal H' to alternatively seal the openings 612 and 613, which means that the valve 601 may be controlled by the signal H' to seal the opening 613 at a third time and to seal the opening 614 at a fourth time.

In the embodiment illustrated in FIG. 6, the valve 601 is disposed by the side s1 of the membrane 605, and the valve 602 is disposed by the side s2 of the membrane 605, where the side s1 and the side s2 are opposite to each other.

In the embodiment illustrated in FIG. 7, the opening 611/613 is at a first direction D1 in related to the valve 601, and the opening 612/614 is at a second direction D2 in related to the valve 602, where the first direction D1 is opposite to the second direction D2. Different from the valves 201-204, the valves 601 and 602 are bi-directional valves, or 2-way valves, which means that the valves 601 and 602 are able to move toward the first direction D1 and also move toward the second direction D2?

Figure 8:
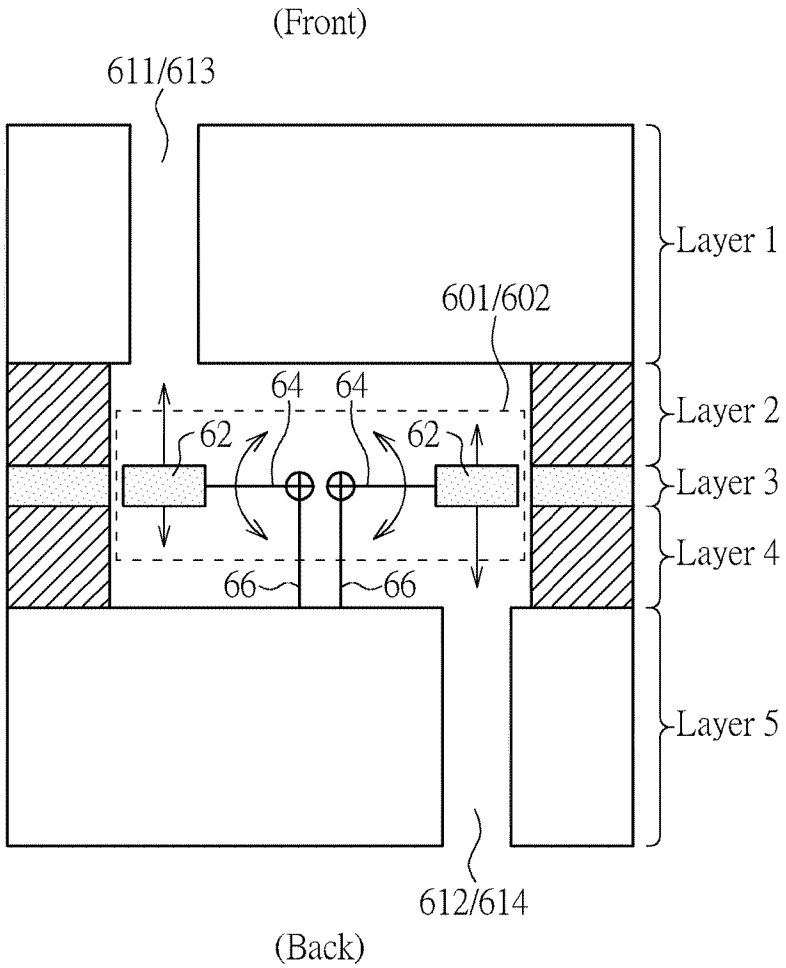
FIG. 8 is a schematic diagram of valve movement according to an embodiment of the present invention.
Figure 8:
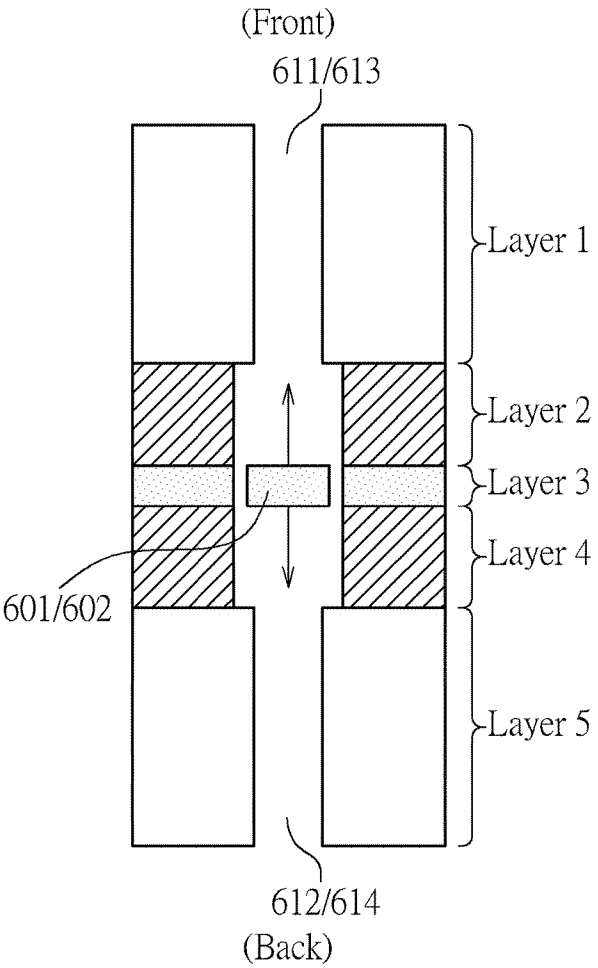

Details of the (dynamic) movement of the valves 601, 602 sealing the openings 611-614 are not limited. In an embodiment, the valves 601, 602 may seal the openings 611-614 by a translational movement or a rotational movement, which are illustrated in FIG. 8. In the sub-FIG. 8*a*, an embodiment of the translational movement is illustrated. The valve 601/602 may be controlled to move upward to seal the opening 611/613 (at the first/third time) and be controlled to move downward to seal the opening 612/614 (at the second/fourth time). In the sub-FIG. 8*b*, an embodiment of the rotational movement is illustrated. The valve 601/602 may comprise caps 62, lever arms 64 and anchors 66. The valve 601/602 may be controlled to rotate clockwise to seal the opening 611/613 (at the first/third time) and be controlled to rotate clockwise to seal the opening 612/614 (at the second/fourth time). In this case, the first/third time may, but not necessarily, be different from the second/fourth time.

Figure 9:
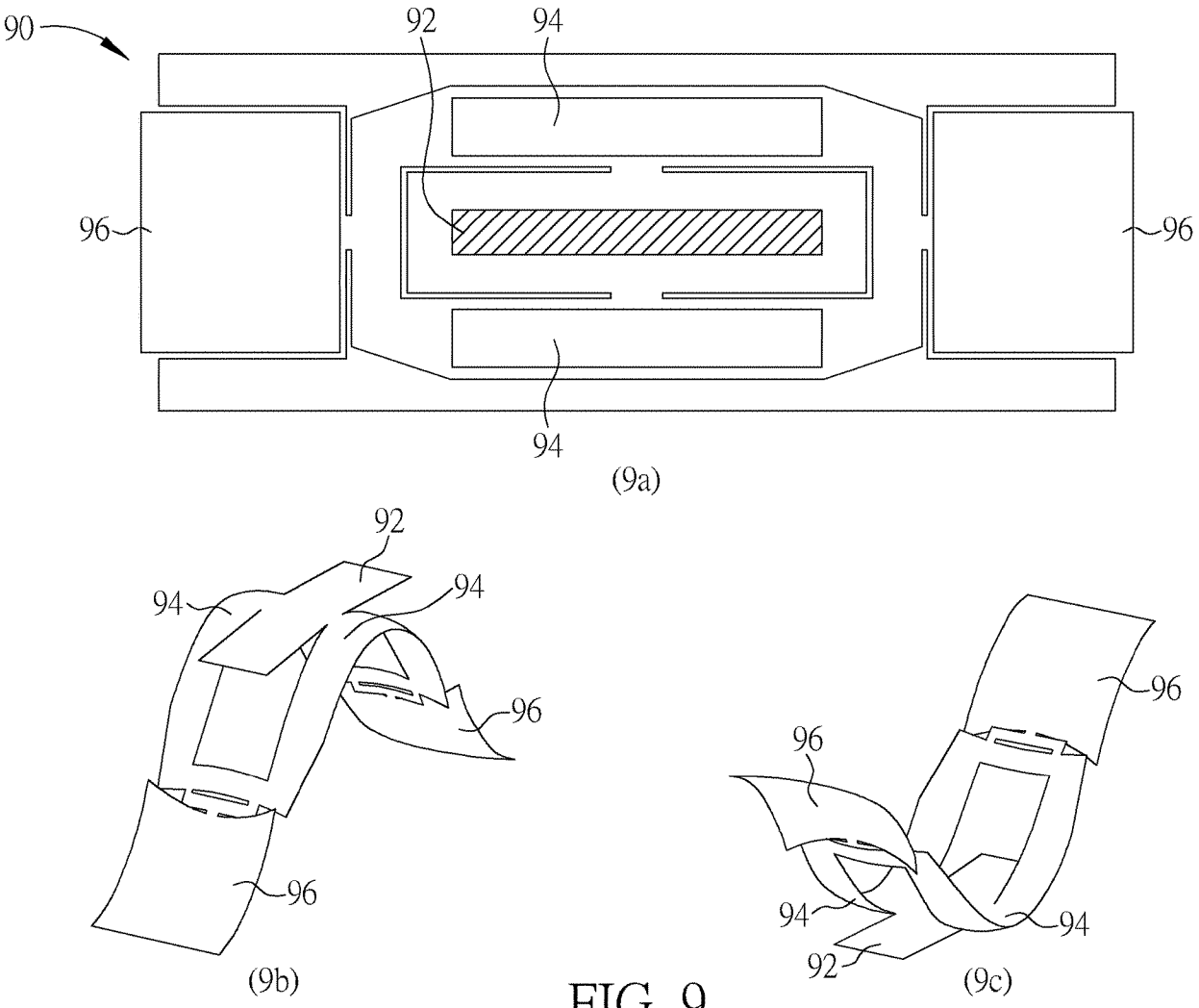
FIG. 9 is a schematic diagram of a valve according to an embodiment of the present invention.
Figure 10:
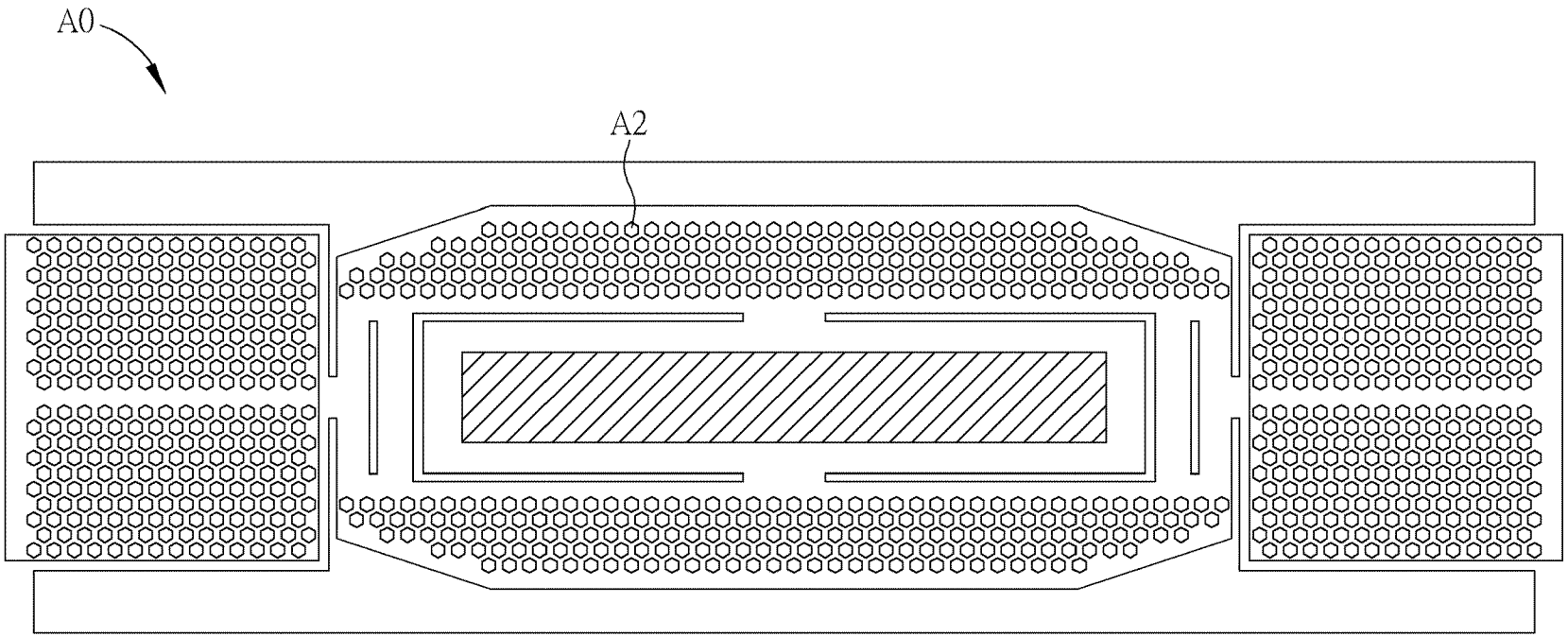
FIG. 10 is a schematic diagram of a valve according to an embodiment of the present invention.

Details of the (static) structure of the valve 601/602 are not limited. For example, FIG. 9 illustrates a schematic diagram of a valve 90 according to an embodiment of the present invention. The valve 90 can be used to realize the valve 601 or 602. The valve 90 comprises a cap 92 and actuators 94, 96. The actuators 94, 96 may be disposed on, either a top surface or a bottom surface, or both surfaces, of the valve 90. When the valve 90 is controlled to be move upward, the actuators 94 deform in a concave manner and the actuators 96 deform in a convex manner, as the sub-FIG. 9*a* illustrates. When the valve 90 is controlled to be move downward, the actuators 94 deform in a convex manner and the actuators 96 deform in a concave manner, as the sub-FIG. 9*b* illustrates.

Furthermore, to shorten the transition period or response time of the valve, the valve may be light weighted. FIG. 9 illustrates a schematic diagram of a valve A0 according to an embodiment of the present invention. The valve A0 can be used to realize the valve 601 or 602. Different from the valve 90, holes may be formed on the valve A0. The holes may be formed by etching. In this case, the response time of the valve A0, in response to the valve signal G'/H', to move either upward or downward, would be shortened, compared to the valve 90.

Figure 11:
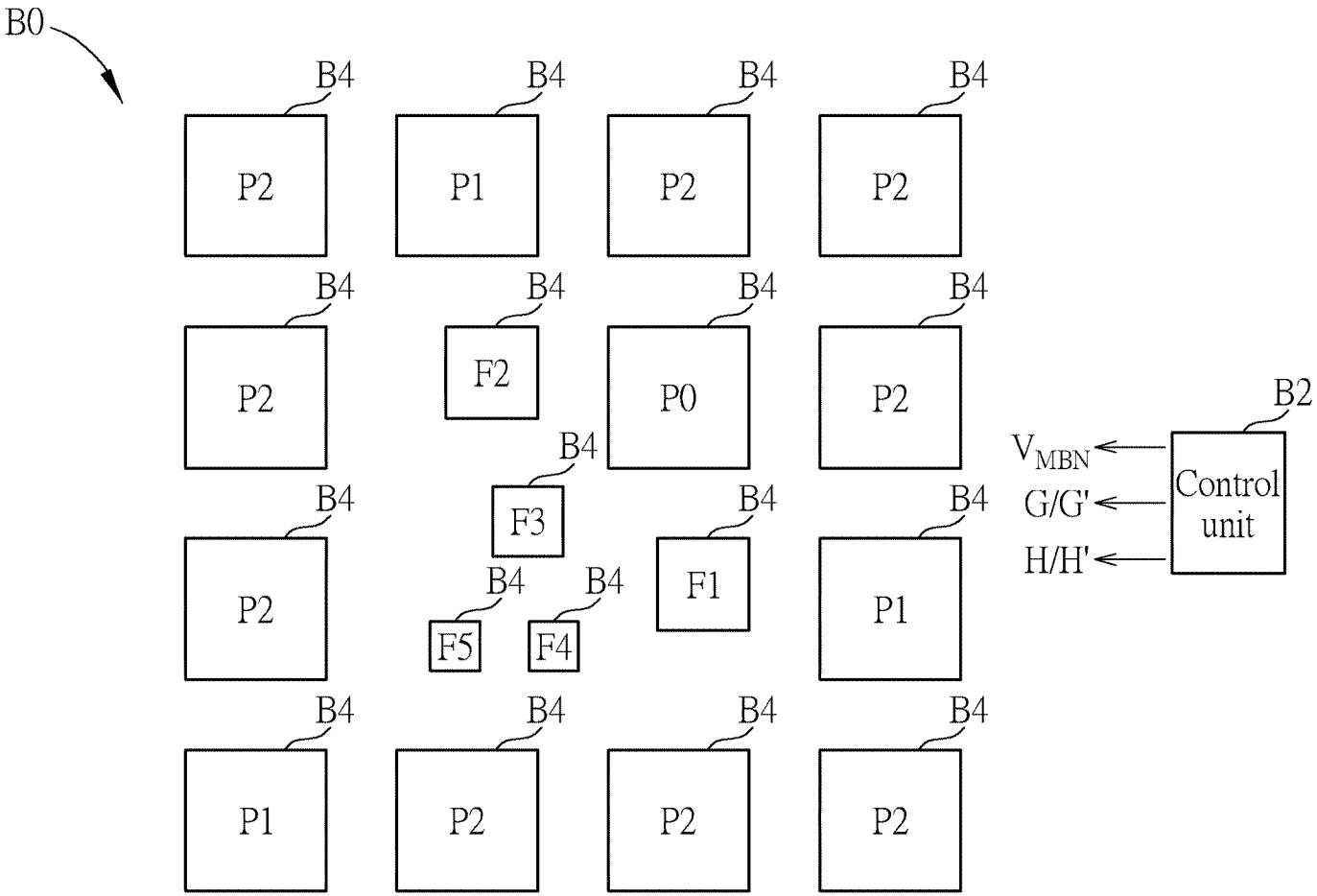
FIG. 11 is a schematic diagram of a sound producing device according to an embodiment of the present invention.

The air pulse generating element 20/60 may be applied/disposed in a sound producing device. FIG. 11 is a schematic diagram of a sound producing device B0 according to an embodiment of the present invention. The sound producing device B0 comprises a plurality of air pulse generating elements B4 and a control unit B2. The plurality of air pulse generating elements B4 are grouped into air pulse generating groups labeled as P0, P1, P2, and F1-F5. The control unit B2 is configured to generate the valve control signals G/G', H/H' and the membrane driving voltage $V_{MBN}$. Details of the sound producing device B0 may be referred to U.S. application Ser. No. 16/125,761, which is not narrated herein for brevity.

In summary, in the air pulse generating element of the present invention, the valves and the membrane are coplanar or fabricated at the same layer, which reduces manufacturing cost and lower the yield rate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An air pulse generating element, disposed in a sound producing device, comprising: a membrane, disposed within a chamber; and a plurality of valves, disposed by the membrane within the chamber, configured to seal a plurality of openings of the chamber in response to a plurality of valve control signals;

wherein the membrane and the plurality of valves are all fabricated at a first layer;

wherein the plurality of valves comprises:

a first valve, controlled by a first valve control signal, configured to seal a first opening of the chamber at a first time and to seal a second opening of the chamber at a second time:

a second valve, controlled by a second valve control signal, configured to seal a third opening of the chamber at a third time and to seal a fourth opening of the chamber at a fourth time;

wherein the first opening is formed on a first faceplate of the air pulse generating element, and the first faceplate is disposed at a second layer;

wherein the second opening is formed on a second faceplate of the air pulse generating element, and the second faceplate is disposed at a third layer;

wherein the third opening is formed on the first faceplate of the air pulse generating element;

wherein the fourth opening is formed on the second faceplate of the air pulse generating element.

2. The air pulse generating element of claim 1, comprising:

a first valve, configured to seal a first opening of the chamber in response to a first valve control signal, wherein the first opening is formed on a first faceplate of the air pulse generating element, and the first faceplate is disposed at a second layer;

a second valve, configured to seal a second opening of the chamber in response to a second valve control signal, wherein the second opening is formed on a second faceplate of the air pulse generating element, and the second faceplate is disposed at a third layer;

a third valve, configured to seal a third opening of the chamber in response to a third valve control signal, wherein the third opening is formed on the first faceplate; and a fourth valve, configured to seal a fourth opening of the chamber in response to a fourth valve control signal, wherein the fourth opening is formed on the second faceplate of the air pulse generating element.

3. The air pulse generating element of claim 2, wherein the first valve is disposed by a first side of the membrane;

the second valve is disposed by a second side of the membrane;

the third valve is disposed by a third side of the membrane; and the fourth valve is disposed by a fourth side of the membrane.

4. The air pulse generating element of claim 3, wherein the first side is opposite to the second side, and the third side is opposite to the fourth side.

5. The air pulse generating element of claim 1, wherein the first valve is disposed by a first side of the membrane; and the second valve is disposed by a second side of the membrane.

6. The air pulse generating element of claim 5, wherein the first side is opposite to the second side.

7. The air pulse generating element of claim 1, wherein the first opening is at a first direction in related to the first valve;

the second opening is at a second direction in related to the first valve; and the first direction is opposite to the second direction.

8. The air pulse generating element of claim 1, wherein the first valve is controlled to seal the first opening or the second opening by a translational movement or a rotational movement.

9. The air pulse generating element of claim 1, wherein the first valve comprises a cap, configured to seal one of the first opening and the second opening; a first actuator, configured to deform in a concave manner; and a second actuator, configured to deform in a convex manner.

10. The air pulse generating element of claim 1, wherein a plurality of holes is formed on the first valve.

11. The air pulse generating element of claim 1, wherein the air pulse generating element generates a plurality of air pulses in response to the plurality of valve control signals at a pulse rate, and the pulse rate of the plurality of air pulses is higher than a maximum audible frequency.

12. A sound producing device, comprising: a plurality of air pulse generating elements, wherein an air pulse generating element comprises: a membrane, disposed within a chamber; and a plurality of valves, disposed by the membrane within the chamber, configured to seal a plurality of openings of the chamber in response to a plurality of valve control signals; wherein the membrane and the plurality of valves are all fabricated at a first layer; wherein the plurality of valves comprises:

a first valve, controlled by a first valve control signal, configured to seal a first opening of the chamber at a first time and to seal a second opening of the chamber at a second time;

a second valve, controlled by a second valve control signal, configured to seal a third opening of the chamber at a third time and to seal a fourth opening of the chamber at a fourth time;

wherein the first opening is formed on a first faceplate of the air pulse generating element, and the first faceplate is disposed at a second layer;

wherein the second opening is formed on a second faceplate of the air pulse generating element, and the second faceplate is disposed at a third layer;

wherein the third opening is formed on the first faceplate of the air pulse generating element;

wherein the fourth opening is formed on the second faceplate of the air pulse generating element; and a control unit, configured to generate the plurality of valve control signals.

13. The sound producing device of claim 12, wherein the air pulse generating element comprises:

a first valve, configured to seal a first opening of the chamber in response to a first valve control signal, wherein the first opening is formed on a first faceplate of the air pulse generating element, and the first faceplate is disposed at a second layer;

a second valve, configured to seal a second opening of the chamber in response to a second valve control signal, wherein the second opening is formed on a second faceplate of the air pulse generating element, and the second faceplate is disposed at a third layer;

a third valve, configured to seal a third opening of the chamber in response to the second valve control signal, wherein the third opening is formed on the first faceplate of the air pulse generating element; and a fourth valve, configured to seal a fourth opening of the chamber in response to the first valve control signal, wherein the fourth opening is formed on the second faceplate of the air pulse generating element.

14. The sound producing device of claim 13, wherein the first valve is disposed by a first side of the membrane;

the second valve is disposed by a second side of the membrane;

the third valve is disposed by a third side of the membrane; and the fourth valve is disposed by a fourth side of the membrane.

15. The sound producing device of claim 14, wherein the first side is opposite to the second side, and the third side is opposite to the fourth side.

16. The air pulse generating element of claim 13, wherein the first valve is disposed by a first side of the membrane; and the second valve is disposed by a second side of the membrane.

17. The air pulse generating element of claim 16, wherein the first side is opposite to the second side.

18. The sound producing device of claim 12, wherein the air pulse generating element generates a plurality of air pulses in response to the plurality of valve control signals at a pulse rate, and the pulse rate of the plurality of air pulses is higher than a maximum audible frequency.

* * * * *